United States Patent [19]

Lama

[11] 4,166,779

[45] Sep. 4, 1979

[54] ELECTROLYTIC PROCESS FOR PRODUCING ALUMINIUM

[75] Inventor: Antonio Lama, Bolzano, Italy

[73] Assignee: Societá Alluminio e Metalli Alumetal S.p.A., Milan, Italy

[21] Appl. No.: 770,171

[22] Filed: Feb. 18, 1977

[51] Int. Cl.[2] ..... C25C 3/06
[52] U.S. Cl. ..... 204/67
[58] Field of Search ..... 204/67

[56] References Cited

U.S. PATENT DOCUMENTS

| | | | |
|---|---|---|---|
| 2,919,174 | 12/1959 | Pring | 204/67 |
| 3,243,364 | 3/1966 | Kittlaus et al. | 204/67 |
| 3,827,955 | 8/1974 | Bahri et al. | 204/67 |

*Primary Examiner*—Howard S. Williams
*Attorney, Agent, or Firm*—Guido Modiano; Albert Josif

[57] ABSTRACT

An improved electrolytic process for producing aluminium is disclosed, wherein lithium carbonate bath additive is added to the flow of the electrolytic fumes which contain hydrogen fluoride. The solid products formed are separated from the fumes flow and are fed to the electrolytic cells.

3 Claims, 1 Drawing Figure

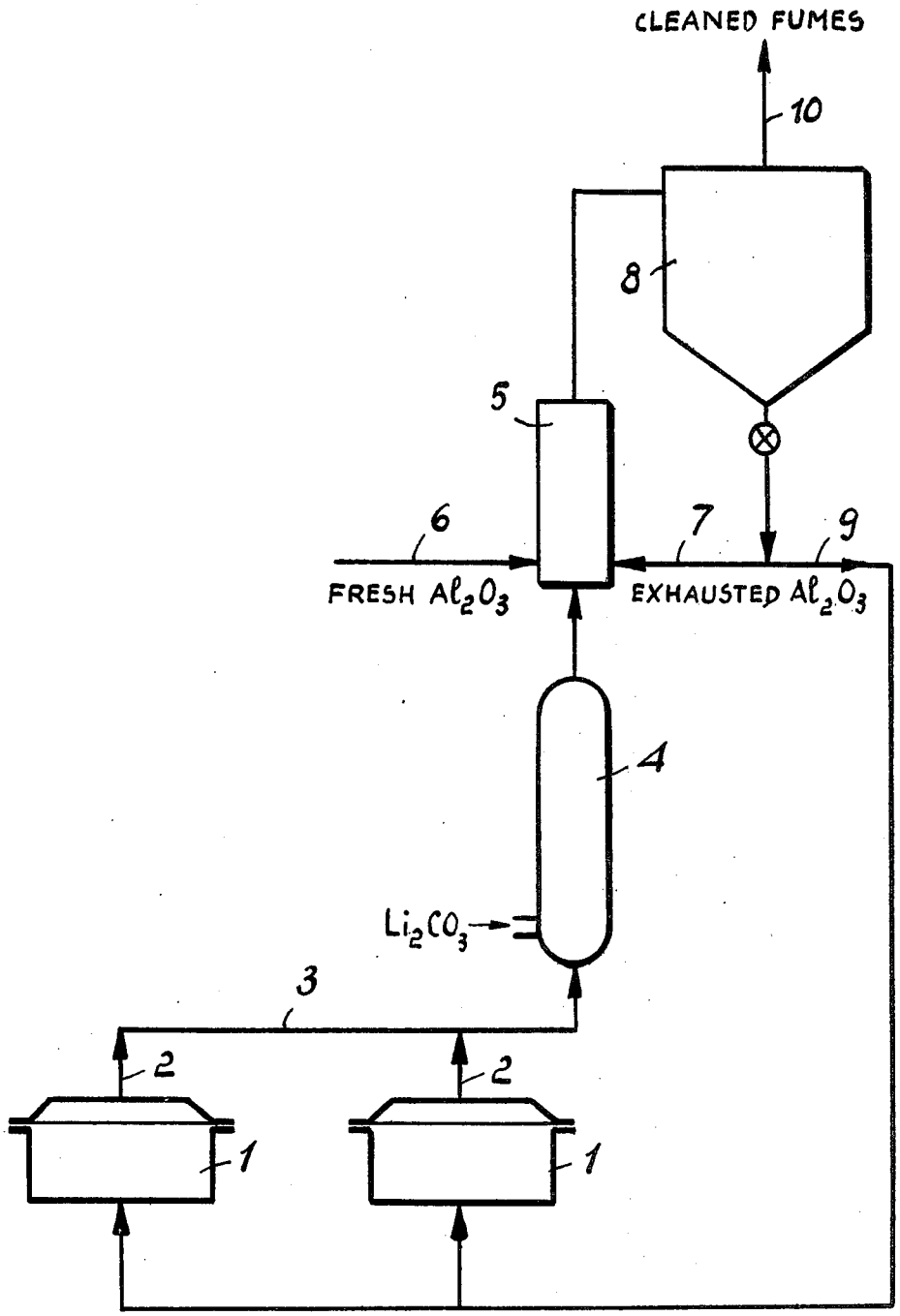
CLEANED FUMES
10
8
5
6
7
9
FRESH $Al_2O_3$
EXHAUSTED $Al_2O_3$
4
$Li_2CO_3$
3
2
2
1
1

ELECTROLYTIC PROCESS FOR PRODUCING ALUMINIUM

BACKGROUND OF THE INVENTION

This invention relates to electrolytic process for producing aluminium, and more particularly to processes which employ lithium salts as one of the electrolytic bath additives.

The electrolytic baths in aluminium manufacturing processes comprise generally besides the basic components consisting of alumina ($Al_2O_3$) dissolved in molten cryolite ($Na_3AlF_6$), some additives which improve certain bath characteristics.

Among such additives, lithium salts, and particularly lithium carbonate ($Li_2CO_3$), have recently found a widespread use due mainly to the fact that they enhance the electric conductivity of the cryolite baths and can lead accordingly to two alternative advantages. One advantage is the possibility of increasing the distance between electrodes at constant ohmic drop with consequent improvement in faradic yield of the respective cells. Alternatively, it is possible to increase the intensity of the current in electrolysis at constant distance between electrodes and constant ohmic drop, achieving in this case an increased cell productivity.

The main problem connected with the use of lithium carbonate in these processes consists in the necessity of reducing the specific consumptions of this bath additive owing to its high cost.

In the known processes the lithium carbonate was generally added to the electrolytic cells during their feeding with alumina, and this operation was usually a manual one consisting in strewing daily on the crust of the baths the required amount of the lithium salt and breaking up the crust to let into the baths this feed material. This method gave however rise to remarkable losses of lithium salt by vaporization and "dusting". The "dusting" phenomenon consisted in the reduction of the feed material in the form of a "dust" and its loss by dispersion, caused both by the mechanical action of breaking up the crust and the following chemical reaction which lithium carbonate had undergone on contacting the cryolitic bath:

$$\text{(I)}\ 3Li_2CO_3+2AlF_36LiF+3CO_2+Al_2O_3$$

The carbon dioxide evolved in the reaction entrained off remarkable amounts of lithium containing feed material in the form of a "dust". Since in the cells provided with hoods this feeding step is usually carried out with lifted cell hoods the so entrained quantity of lithium salt was non-recoverable and represented accordingly a net loss of material.

Besides these losses of lithium carbonate during the feeding step, further loss occurs by slow vaporization during operation of the cells and by slow impregnation in the carbon lining of the electrolytic cells. In quantitative terms, considering a desired concentration of lithium salt, expressed as LiF, in the cryolitic baths of about 3 to 5%, the above mentioned losses led to a specific consumption during operation of cells of about 5 to 10 Kg. $Li_2CO_3$/ton Al.

In order to diminish the specific consumptions of lithium carbonate in electrolytic cells of prebaked anode type by diminishing the "dusting" phenomenon during the feeding of $Li_2CO_3$ to the cells a slow introduction of this additive in the electrolytic bath has been proposed such as by premixing the lithium carbonate with the alumina before their addition to the cells or by adding instead of lithium carbonate powder the more expensive lithium carbonate pellets. For cells of Söderberg anode type there has also been proposed to add powdered $Li_2CO_3$ to the anodic paste.

SUMMARY OF THE INVENTION

It is an object of the present invention to provide an electrolytic process for producing aluminium in which reduced specific consumptions of lithium carbonate as bath additive are achieved in an inexpensive way, whithout the use of particular or sophisticated techniques.

Another object of the present invention is to provide an electrolytic process for aluminium manufacture wherein the step of feeding lithium carbonate as bath additive lends itself easily to automation so avoiding time consuming manual work.

According to the present invention there is provided an electrolytic process for producing aluminium from an electrolytic bath comprising alumina dissolved in molten cryolite wherein lithium carbonate is used as an additive to the electrolytic bath, the improvement comprising contacting the lithium carbonate with the hydrogen fluoride containing fumes from the electrolytic cells, recovering from said fumes the suspended solids and feeding said solids to the electrolytic cells.

In the present process, the lithium carbonate reacts with the hydrogen fluoride contained in the primary fumes developed during the operation of the electrolytic cells, according to the following reaction:

$$\text{(II)}\ Li_2CO_3+2HF2LiF+CO_2+H_2O$$

This is a solid-gas type reaction which is preferably carried out at about 80°-110° C. with almost quantitative yields By using an appropriate dosage of the reactants, i.e. lithium carbonate as a function of the flow rate of the electrolysis fumes and their content of hydrogen fluoride, the former can be converted almost quantitatively into lithium fluoride. In this way, after their recovering from the fumes, the solids which are fed to the electrolytic cells contain prevailingly LiF thus avoiding any drawback relative to a direct addition of lithium carbonate to the electrolytic bath.

The present process can be actuated by feeding the lithium salt and fumes from the electrolysis process to a contact zone, the rate of the gas flow being sufficient to ensure a good mixing and dispersion of the salt for achieving a good contact between the reactants. For giving the fumes a sufficient rate it is possible for example to feed them into the contact zone through a Venturi tube arrangement. After the passage through the contact zone, the flow of fumes containing suspended solids, which consist prevailingly of lithium fluoride and of a minor proportion if any of non-reacted lithium carbonate, is passed to a separation zone where the solids are recovered and then fed to the electrolytic cells. The fumes are then fed to a cleaning step where the non-reacted hydrogen fluoride is recovered by any conventional method.

BRIEF DESCRIPTION OF THE DRAWING

The FIGURE is a schematic view of a plant in which the present process can be advantageously actuated.

DESCRIPTION OF THE PREFERRED EMBODIMENTS

In a preferred embodiment of the invention, after having contacted the electrolysis fumes with the lithium carbonate, the gas flow containing said suspended solids was passed firstly to a cleaning or hydrogen fluoride recovering step carried out by a dry method, preferably with alumina adsorbent. It is known that alumina has the property of chemo-adsorbing HF on monomolecular layer. The reaction takes place very quickly, with yields of purification of the electrolysis fumes of near 100%.

In this embodiment, after the cleaning step, the gas flow containing as suspended solids lithium fluoride, a minor proportion or any lithium carbonate and exhausted alumina, is passed to a solid recovering step, carried out for example by conventional filtering means. The separated solids are recycled to the electrolytic cells where they are combined with the fresh feeding material.

It was found that with the process of this invention the specific consumption of lithium carbonate during operation of an electrolytic plant can be reduced to about 2.5–3.5 Kg./ton Al.

Advantageously the process of the present invention can be actuated in an electrolytic plant for producing aluminium provided with a dry cleaning unit for the electrolysis fumes of conventional type, for example a dry cleaning unit which employs alumina adsorbent.

An embodiment of the invention will now be more particularly described by way of example with reference to the accompanying drawing.

With reference to the drawing, there are indicated with 1 the cells of an electrolytic plant having prebaked type anodes. (For sake of convenience there are illustrated only two such cells.) The primary fumes developed in the electrolytic cells are withdrawn from the cell hoods (not illustrated) and are conveyed by respective single pipes 2 into a manifold line 3. During their passage through the manifold line 3 the fumes undergo cooling until a temperature of about 80°–110° C. is reached. The fumes with this temperature are conveyed to a contact zone 4 for contacting lithium carbonate. The contact zone was in the form of a suitable reaction vessel. In a modification the contact zone can consist of a section of the manifold 3 itself of sufficient length to allow a complete reaction to occur between the reactants. The lithium carbonate is preferably fed to the contact zone through suitable metering means either intermittently or continuously in small doses so as to have always an excess of HF with respect to lithium carbonate in this contact zone. This latter system is preferred, since an excess of HF shifts the equilibrium of the reaction (II) above, toward the right-hand side and allows a complete conversion of the lithium carbonate into fluoride to be achieved before the fumes come into contact with alumina in the next purifying step. In fact, hydrogen fluoride reacts preferentially with alumina and accordingly lithium carbonate would no more undergo any substantial conversion once the hydrogen fluoride has contacted alumina.

According to a modification the contact between reactants in zone 4 can be increased by increasing the flow rate of the fumes entering the contact zone 4 for example by a Venturi tube arrangement provided at the inlet of zone 4.

The electrolytic fumes which leave the contact zone 4 contained suspended solid materials consisting of lithium fluoride and, in case, some non-reacted lithium carbonate. These fumes are conveyed to a dry cleaning unit for recovering the remaining free HF.

The dry cleaning unit was, as mentioned, a conventional one and comprised a reaction chamber 5 wherein the fumes are brought into contact with alumina adsorbent. The alumina feed to the reaction chamber 5 comprised alumina and exhausted alumina, i.e. alumina containing adsorbed HF, added through two distinct feeders 6 and 7, respectively. The weight ratio between fresh and exhausted alumina fed to the reaction chamber 5 was in the range of about 1:7 to 1:8.

The gases leaving chamber 5 contained now, in the form of suspended solids, besides lithium fluoride and a minor proportion of lithium carbonate, also exhausted alumina, and they were passed to filtering means for recovering these solid materials. The filtering means comprised for example a conventional filter unit 8 with a hopper arranged at the base thereof for collecting the separated solids. The solids withdrawn from the hopper 8 were partly recycled to the gas purifying operation in the reaction chamber 5, through line 7, and partly sent as feed to the electrolytic cells through line 9. The hydrogen fluoride-free fumes were discharged at the top of the filter unit 8, through line 10. The circulation of the electrolysis fumes through the plant facilities was ensured by a suitable ventilation system not shown.

The process of the present invention will be better understood from the following example given by way of illustration only.

EXAMPLE

An electrolytic plant for producing aluminium of the illustrated type comprising a cell assembly of prebaked anode type gave a daily output of 14.5 t/day of aluminium, with a consumption of 27 t/day of starting alumina. The primary fumes evolved during electrolysis had a HF content of about 55 mg/N cu.m. and were withdrawn by suitable suction means with a flow of about 110,000 N cu.m./t of aluminium produced. Accordingly the fumes conveyed to the contact zone for reaction with lithium carbonate carried about 6 kg HF/t of Al produced.

The electrolysis fumes reached the contact zone with a temperature of about 90° C. and a slight depression of about 60–65 mm. $H_2O$ with respect to the atmopheric pressure. Lithium carbonate was added continuously to the contact zone at a rate of about 40–43 kg/day which is equivalent to a specific consumption of 2.75–3 kg/t. Al.

This specific consuption was sufficient to cover the lithium salt losses in the electrolytic cells and to maintain therein a required LiF concentration of about 3% by weight.

Since according to the reaction (II), above, 3 kg/t. Al of lithium carbonate react with a stoichiometric amount of 1.5 kg/t. Al of HF, there was a considerable excess of HF in the contact zone, so that all $Li_2CO_3$ was converted to LiF.

The fumes from the contact zone were conveyed to a reaction chamber of a dry cleaning unit of the illustrated type where they came into contact with alumina adsorbent. In the reaction chamber there was maintained a constant amount of about 5,000–6,000 kg alumina by feeding 700–800 kg/h of fresh alumina with the balance consisting of recycled alumina from the dry cleaning unit.

The fumes from the reaction chamber containing LiF and exhausted alumina in form of suspended solids were freed from these solids in suitable filtering means of the illustrated type and were then discharged. A portion of about 700–800 kg/h of the solids separated in the filtering means was sent as feed to the electrolytic cells while the balance was recycled to the reaction chamber of the dry cleaning unit.

It may be noted that, as mentioned the specific consumption of lithium carbonate was 2.15–3 kg/t. Al as compared to 5–10 kg/t. Al of the known art.

I claim:

1. An electrolytic process for producing aluminium from an electrolytic bath comprising alumina dissolved in molten cryolite, wherein lithium carbonate is used as an additive to the electrolytic bath, the improvement comprising contacting outside the bath the lithium carbonate in solid form with the hydrogen fluoride containing fumes from the electrolytic cells, in a molar ratio between lithium carbonate and the hydrogen fluoride content of the fumes less than 0.5 so as to achieve the conversion of substantially all the lithium carbonate into lithium fluoride, recovering from said fumes lithium fluoride containing suspended solids and feeding said solids to the electrolytic bath.

2. A process according to claim 1, wherein said fumes after the step of contacting lithium carbonate are conveyed to a hydrogen fluoride recovering step carried out by contacting the fumes with alumina adsorbent.

3. A process according to claim 1, wherein the step of contacting the fumes with lithium carbonate is carried out at about 80°–110° C.

* * * * *